US005821849A

United States Patent [19]

Dietsch et al.

[11] Patent Number: 5,821,849

[45] Date of Patent: Oct. 13, 1998

[54] FLEXIBLE BLOWN FUSE INDICATOR

[75] Inventors: G. Todd Dietsch, Park Ridge; Heraclio R. Gomez, Northbrook; Joseph W. Kowalik, Skokie, all of Ill.

[73] Assignee: Littelfuse, Inc., Des Plaines, Ill.

[21] Appl. No.: 896,035

[22] Filed: Jul. 17, 1997

[51] Int. Cl.[6] ..... H01H 45/30; H01H 85/046

[52] U.S. Cl. ..... 337/241; 337/160; 337/297

[58] Field of Search ..... 337/151–153, 337/158, 159, 241, 297, 283, 279, 186, 290, 295, 296, 243, 265, 270

[56] References Cited

U.S. PATENT DOCUMENTS

| | | | |
|---|---|---|---|
| 4,706,059 | 11/1987 | Schmitt | 337/297 |
| 5,091,712 | 2/1992 | Suuronen | 337/297 |
| 5,111,177 | 5/1992 | Krueger et al. . | |
| 5,418,516 | 5/1995 | Oh | 338/21 |

OTHER PUBLICATIONS

U.S. application No. 08/842,964, Dietsch et al., filed Apr. 25, 1997.

*Primary Examiner*—Leo P. Picard
*Assistant Examiner*—Anatoly Vortman
*Attorney, Agent, or Firm*—Wallenstein & Wagner, Ltd.

[57] ABSTRACT

A device for providing a visual indication of the status of a fuse, i.e., whether or not the fuse has blown. The device includes a substrate onto which the elements of the visual indication device are printed. A pair of conductive terminals is screen printed upon that substrate, preferably spaced apart from each other along that substrate. Between the terminals, at least two spaced apart resistance elements are positioned upon the substrate. These two resistance elements are in series with each other, and they are also in series with the pair of conductive terminals. The first of these at least two resistance elements is comprised of a combination of a substance which melts at an elevated temperature, and also of carbon. The second of these at least two resistance elements is comprised solely of carbon.

10 Claims, 4 Drawing Sheets

FLEXIBLE BLOWN FUSE INDICATOR

BACKGROUND OF THE INVENTION

Fuses for electrical and electronic circuits are generally quite reliable. In fact, because the circuits which they are designed to protect are themselves not highly trouble prone, the fuses in those circuits will seldom open, or blow.

Fuses are introduced into the electrical circuits which they protect by their placement within electrical control panels, commonly referred to as fuse boxes. Often, these fuse boxes can contain thirty or more fuses to protect a corresponding number of electrical circuits. These fuses may be identical in outward appearance. To the extent that these fuses do not include a visually discernible indicating means that changes color or state upon the blowing of one of the fuses, it is generally impossible to determine by sight which of the fuses has blown.

There are a number of prior art fuse indicators described in United States patents issued to the assignee of the present application. For example, U.S. Pat. No. 5,111,177, issued to Krueger et al on May 5, 1992, is a blown fuse indicator for a fuse having a cylindrical glass housing. A chemical substance is placed on the fusible link within the cylindrical housing. Upon overload conditions, the chemical substance is vaporized, and condenses upon the inside of the cylindrical fuse housing. Upon vaporization, the chemical substance assumes a color dependent upon the circuit conditions which led to the blowing of the fuse. Accordingly, the color of the inside of the fuse caused by the chemical vaporization suggests the nature of the circuit overload condition which caused the fuse to blow.

Another mechanical blown fuse indicator is described in U.S. patent application Ser. No. 08/842,964, filed on Apr. 25, 1997, and entitled "Blown Fuse Indicator for Electrical Fuse", which is assigned to the assignee of the present invention.

Yet another blown fuse indicator is described in U.S. patent application Ser. No. 08/632,902, filed in the name of Robert Parker, and entitled "Fuse State Indicator."

SUMMARY OF THE INVENTION

The invention is a device for providing a visual indication of the status of a fuse, i.e., whether or not the fuse has blown. The device includes a substrate onto which the elements of the visual indication device are printed. A pair of conductive terminals is typically screen printed upon that substrate, and those terminals are preferably spaced apart from each other along that substrate.

At a location preferably intermediate of the terminals, at least two resistance elements are positioned upon the substrate. These two resistance elements are in series with each other, and they are also in series with the pair of conductive terminals. The resistance elements are spaced apart.

The first of these at least two resistance elements is comprised of a combination of a substance which melts at an elevated temperature, and also of carbon. The second of these at least two resistance elements is comprised solely of carbon.

In yet another aspect of this invention, the conductive terminals are imprinted upon the substrate at the opposite ends of that substrate.

A still further aspect of the invention comprises a substrate made of a clear polyester sheet. In yet another aspect of the invention, the conductive terminals are comprised of silver or tin.

In another aspect of the invention, the imprinted conductive terminals are a part of a grid that connects the terminals to each other, and also connects those terminals to the resistance elements. In a still further aspect of the invention, the grid is screen printed onto said substrate.

Other features and advantages of the invention will be apparent from the following specification taken in conjunction with the following drawings.

DETAILED DESCRIPTION OF THE PREFERRED EMBODIMENT

This invention is susceptible of embodiments in many different forms. The drawings and this specification describe in detail a preferred embodiment of the invention. This disclosure is, however, considered but one example of the principles of the invention. Thus, the disclosure is not intended to limit the broad aspect of the invention to the illustrated embodiment.

Figure 1:
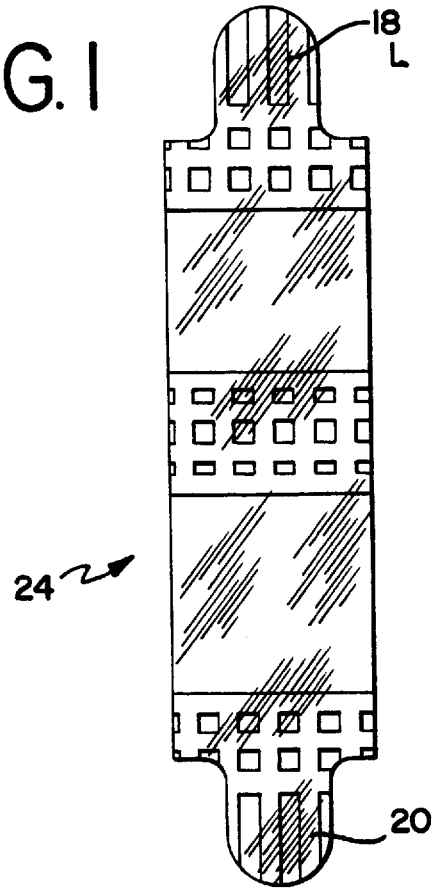
FIG. 1 is a perspective view of a device for providing a visual indication of a blown fuse condition, in accordance with the invention.
Figure 2:
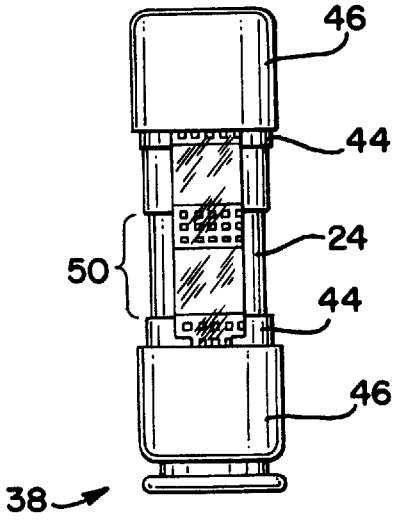
FIG. 2 is a perspective view of the device of FIG. 1, and attached to a fuse.
Figure 3:
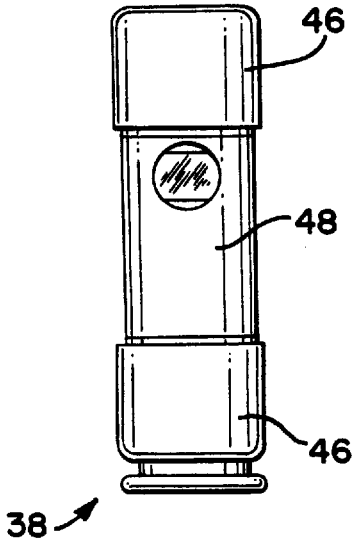
FIG. 3 is a perspective view of the fuse of FIG. 2, but with a label overlaying the fuse body.

The invention is a device for providing a visual indication of the status of a fuse, i.e., whether or not the fuse has blown. The finished indicator device 24 is shown in FIG. 1, and typical applications of the device are shown in FIGS. 2 and 3.

The device includes a substrate 10. This substrate 10 is preferably made of a clear polyester sheet, but it can also be made of several other thin, flexible sheet-like materials, including mylar or Kapton flexible sheet. The preferred substrate is a clear, polyester sheet manufactured by ICI Films as Part No. Kaladex 1030. The film is three (3) mils thick, and is a Grade 300, clear polyester.

Figure 4:
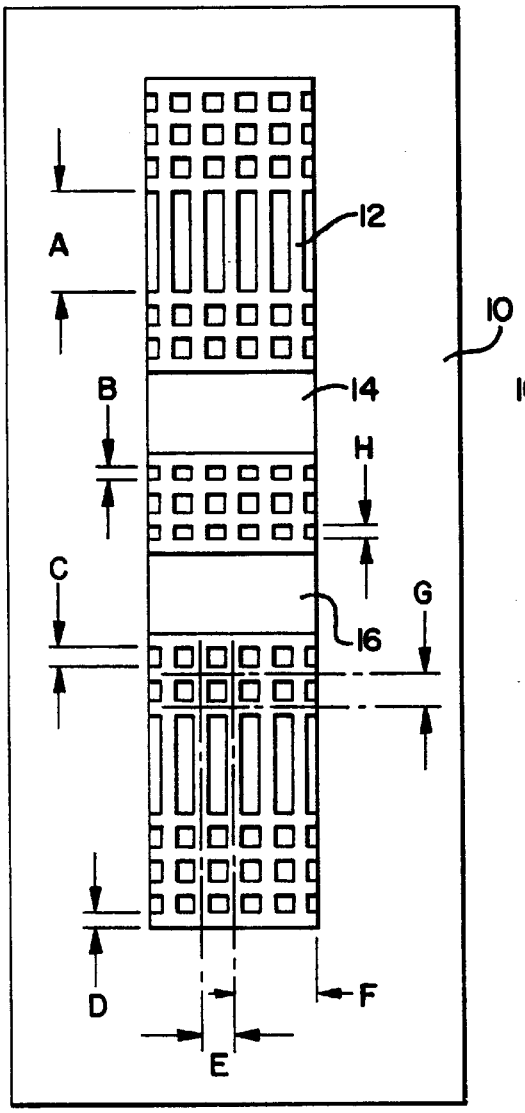
FIG. 4 is a plan view of a substrate for the manufacture of the device of the invention, with the grid and terminals imprinted on that substrate.

As suggested above, a screen printing process is used to place a grid 12 onto the substrate 10. FIG. 4 shows a sheet of the substrate 10 onto which this grid 12 has been placed. FIG. 4 also provides some of the dimensions for the grid 12 on that substrate 10.

In placing the grid 12 onto the substrate 10, any number of conductive or low resistive inks may be used. For the present invention, a preferred conductive ink is a silver polymer thick film (PTF) ink, which is supplied by Acheson as Part No. 28RF100C. It will be understood by those skilled in the art that other metal polymer thick film inks, such as a tin PTF ink, may be used in lieu of the silver PTF ink described above. In this way, the grid 12 and its integral terminals would be made of tin, rather than silver.

In the screen printing process well known in the art, a conductive ink is placed on the top of a screen having a predetermined pattern. In connection with the present invention, the first of several screens used in the manufacture of the invention is designed to provide the grid pattern shown on the substrate 10 of FIG. 4.

The conductive ink typically has a viscous or paste-like consistency. As a result, when it is placed upon the screen, it tends to stay above the surface of the screen, rather than move through the holes of the screen onto the surface of the substrate 10. To move the paste to the substrate 10, a wiper or squeegee type of implement is moved across the upper surface of the screen. As the wiper is moved across the surface of the screen, a portion of the conductive ink paste is forced through openings in the screen. The screen is then lifted from the surface of the substrate, and the paste is allowed to dry on the substrate. The resulting structure is a grid 12 of FIG. 4.

As may be seen in FIG. 4, the grid 12 pattern is continuous, except for two temporarily open regions 14 and 16. The portions of the grid 12 on either side of, and between, these regions 14 and 16 are not electrically connected to each other. Instead, these portions of the grid 12 will be subsequently electrically connected to each other by additional elements placed onto the substrate 10, as will be described below.

In the preferred embodiment, the grid is cut in a manner that will result in the formation of a pair of integral terminals 18 and 20. Because these terminals 18 and 20 are integral with the grid 12, they are made of the same material as the grid 12. As may best be seen in FIG. 1, the terminals 18 and 20 are preferably spaced apart from each other along the substrate 10. Most preferably, as may be seen in FIGS. 1, 8, and 10, the conductive terminals 18 and 20 are imprinted upon the substrate 10 at the opposite ends of that substrate 10.

After the ink has dried on the substrate 10 to create the grid 12, as shown in FIG. 4, the first of two or more resistance elements is placed onto the substrate. The first 22 of the two resistance elements for this finished indicator 24 are placed onto the substrate at the temporarily open region 14. FIG. 1 depicts the location of the first resistance element 22 on the finished indicator 24.

As may be seen in the FIGURES, the at least two resistance elements 22 and 26 are preferably placed at a location that is intermediate of (i.e., between) the terminals 18 and 20. In this way, these two resistance elements 22 and 26 are in series with each other, and the elements 22 and 26 are also in series with the pair of conductive terminals. Like the terminals 18 and 20, the resistance elements 22 and 26 are also spaced apart from each other. A portion 30 of the grid 12 is located in the space 28 between the resistance elements 22 and 26. This portion 30 of the grid 12 will electrically connect resistance element 22 to resistance element 26.

The first 22 of these at least two resistance elements is comprised of two separate components. The first component is a substance which melts at an elevated temperature, and the second component is a carbon-based product.

Figure 5:
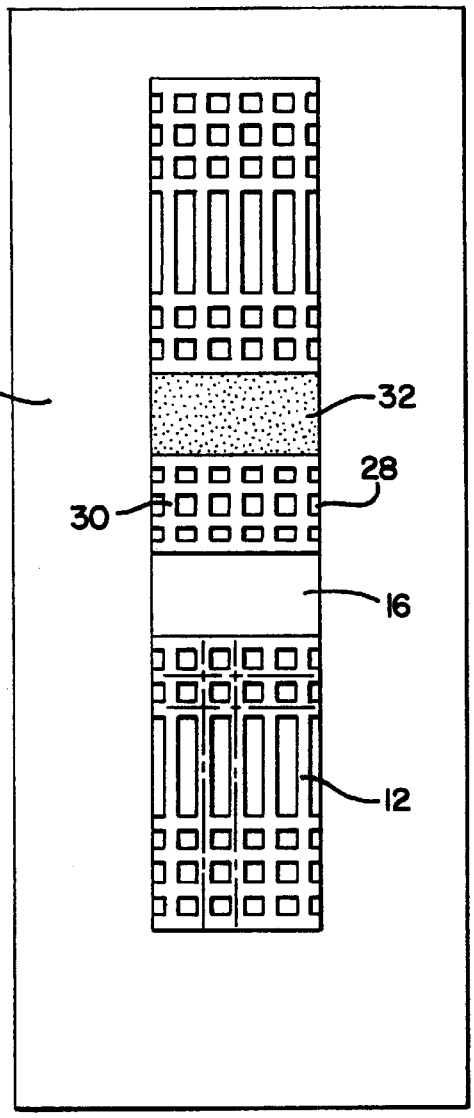
FIG. 5 is a plan view of the substrate of FIG. 4, but with the wax portion of the first resistance element placed onto that substrate.

FIG. 5 shows the placement of the first resistance element 22 onto the substrate 10. Like the grid 12, the first resistance element 22 is screen printed onto the substrate 10. Unlike the grid 12, the first resistance element is screen printed onto the substrate 10 in two steps.

In the first step, as shown in FIG. 5, a light gray-colored wax 32 is printed onto the temporarily open region 14. The width of the wax is approximately 3/16". The wax 32 that is used is supplied by Acheson as Part No. PM-010. Essentially, the wax 32 is in the form of a wax powder that is mixed with a binder. Again, the wax 32 is viscous, and like a paste in consistency, and it is screened onto the substrate. In lieu of this binder-laden wax 32, other substances may be used, as for example a thermochromic ink.

Figure 6:
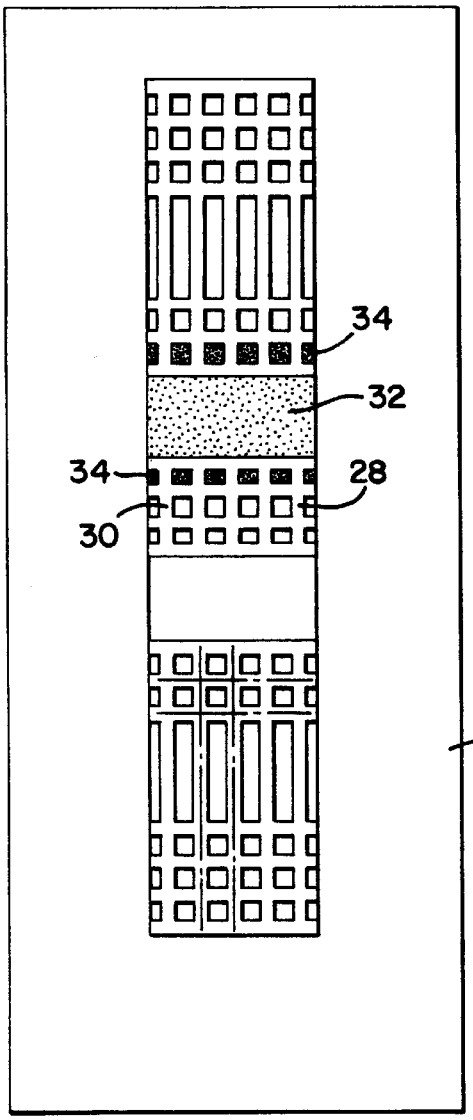
FIG. 6 is a plan view of the substrate of FIG. 5, but with the carbon portion of the first resistance element placed onto the wax porion and onto the substrate.

In the second step, after this grayish wax 32 has dried onto the temporarily open region 14 of the substrate 10, a carbon strip 34 is placed over the wax 32 and also over the adjacent ends of the grid 12, again through a screen printing process. The resulting sub structure is shown in FIG. 6. A carbon PTF ink is used to make this carbon strip 34. This carbon PTF ink is supplied by Acheson as Part No. 42355.

The width of the carbon strip 34 is somewhat wider than the width of the wax strip 32. For example, if the wax strip has a width of 3/16", then the carbon strip 34 has a width of approximately 5/16". Because the carbon strip 34 is centered over the wax strip 32, about 1/16" of the carbon strip 34 extends outwardly from each side of the wax strip 32. This ensures good electrical contact between the carbon strip 34 and the grid 12.

Figure 7:
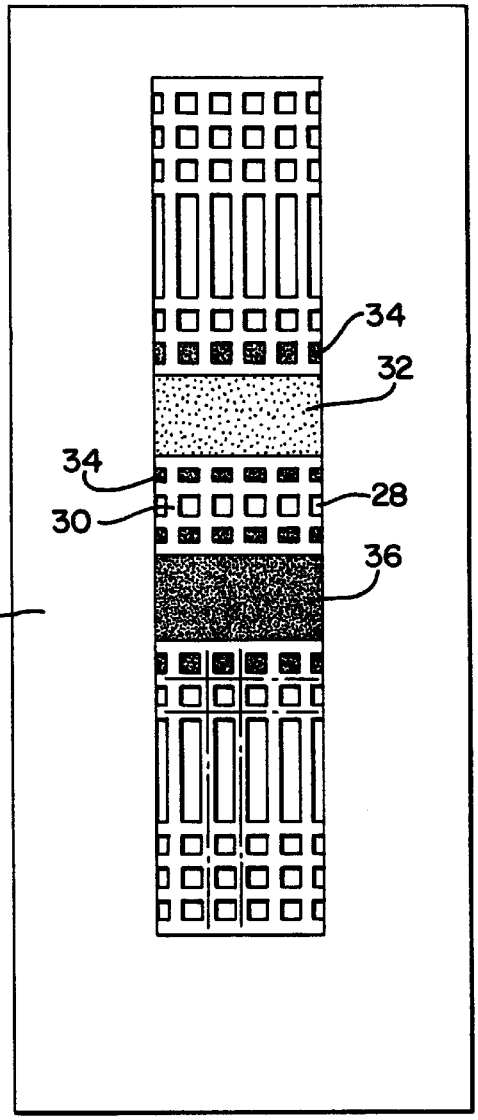
FIG. 7 is a plan view of the substrate of FIG. 5, but with the second resistance element placed onto a region of the substrate spaced apart from the first resistance element.

The second 26 of these at least two resistance elements is comprised solely of carbon, rather than of a wax and a carbon. It follows that the second resistance element 26 is itself comprised solely of a carbon strip 36. This strip 36 is made using the same carbon PTF ink is supplied by Acheson as Part No. 42355, and is again applied using a screen printing process. Like the first carbon strip 34, this second carbon strip 36 has a width of approximately 5/16". The substrate 10, with the second carbon strip 36 having been applied, is shown in FIG. 7.

The first 34 and second carbon strips 36 generally have different resistivities. For this reason, they are screened onto the wax or the substrate 10 in separate steps. A greater amount of carbon in the carbon PTF ink leads to a lower silver loading, and therefore to higher resistivity. Resistivity can also be controlled by changing the thickness of the carbon strips 34 and 36. Different resistance values of the carbon strips are necessary in order to properly coordinate the two or more resistance areas. For the fuses shown in FIGS. 2–3, the particular indicator shown in FIG. 1 is used. A typical resistance of the carbon strip 34 is approximately 335 ohms, while the typical resistance of carbon strip 36 is approximately 250 ohms.

Figure 8:
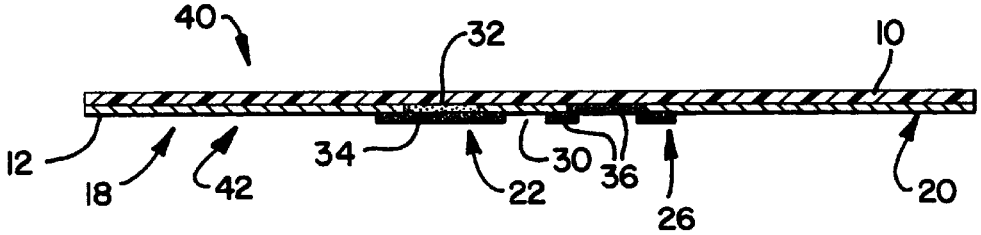
FIG. 8 is a side view of the structure of FIG. 1.

As may be seen in FIG. 8, the first 22 and second resistance elements 26 do not touch each other. Rather, they are separated by, and electrically connected to, the intermediate portion 30 of the grid 12. This first resistance element 22 is referred to as the "indication resistor", as it provides a visual indication when the fuse to which it is attached has blown. The second resistance element 26 is also referred to as a "clearing resistor", as it stops the passage of current through the finished indicator 24 after the "indication resistor" has provided an indication of a blown fuse condition.

In order for these two resistor areas to work together properly and maintain safe operation, the clearing resistor 34 must be coordinated with the indication resistor 36. During normal operation of the indicator device, the energies present can be broken down into three distinct types of energy or $i^2t$ values. The first of these values is the melting $i^2t$ of the wax material. This is the amount of energy converted into heat by the indication resistor 36 in order to melt the wax material and thus provide a visual indication that the fuse has opened.

The second energy value is the melting $i^2t$ of the clearing resistor. This is the amount of energy required to melt the substrate under the clearing resistor, thereby opening the circuit. This energy is the combined melting $i^2t$ of the wax material and the additional energy required to bring the substrate to its melting point.

The third energy value is the arcing $i^2t$ of the clearing resistor. This is the energy required to consume the material of the clearing resistor, and thus build up dielectric in the clearing resistor area. It should be apparent to those skilled in the art that the indication resistor will have distinct melting and arcing $i^2t$ values, as well. The rationale behind the coordination of these two resistors is to design the device such that the total $i^2t$ value of the clearing resistor 34, which is the combination of the melting $i^2t$ and arcing $i^2t$, is less than the melting $i^2t$ of the indication resistor. This will ensure that the indicator device is never exposed to the amount of energy required to actually melt the indication resistor, which could cause severe arcing in the visual portion of the device.

Figure 9:
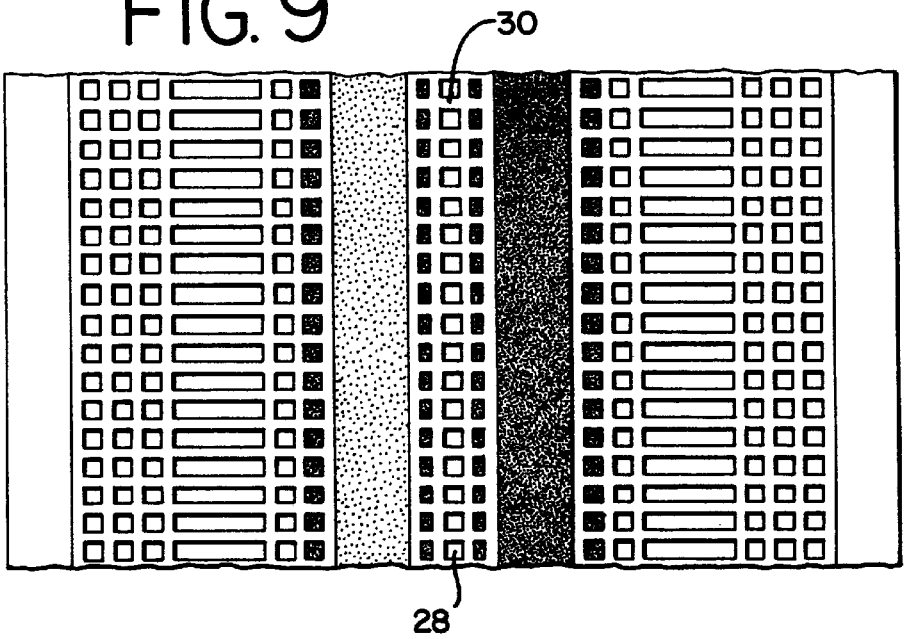
FIG. 9 is an unscored polyester substrate sheet after production has been completed, with this sheet being ready for die-cutting to create adjacent individual strips, like those shown in FIG. 1, in accordance with the invention.
Figure 10:
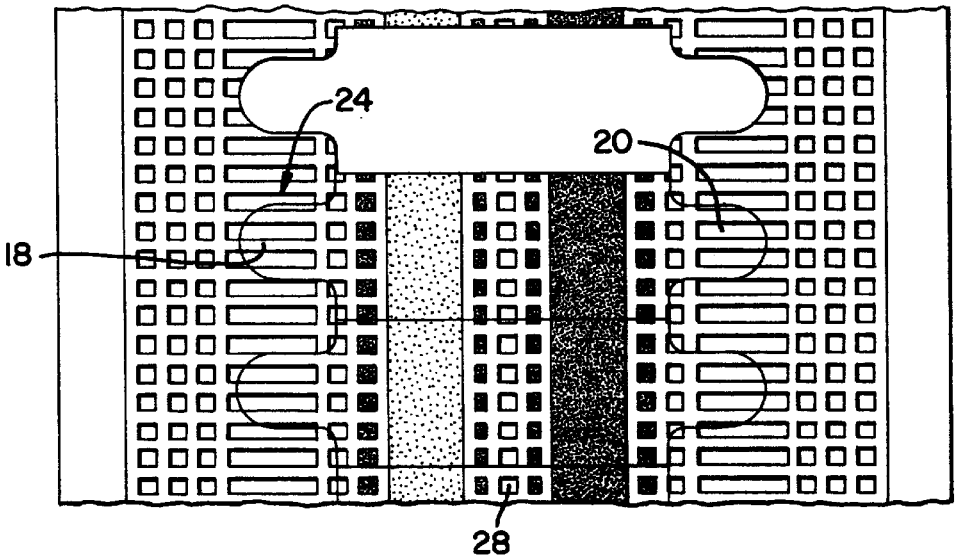
FIG. 10 is a view of the sheet of FIG. 9, but after scoring to create a plurality of die-cut devices of FIG. 1, in accordance with the invention.

Upon completion of the above steps, the treated substrate 10 has the appearance shown in FIG. 9. The structure of FIG. 9 is then die cut, as shown in FIG. 10. The resulting die-cut strips are then separated from the structure of FIG. 10, creating finished indicators 24 of the invention, as may be seen in FIG. 1.

The indicator 24 is then incorporated onto a fuse 38. The fuse 38 for which the present indicator 24 is designed is a 30-amp, 250-volt "case size" fuse, shown in FIGS. 2 and 3. These fuses 38 have a length of approximately two inches, and a diameter of approximately one-half (½) inch. The cut indicator 24 of FIG. 1 has a length of approximately 1⅛", and a width, at its widest point, of approximately ¼".

FIG. 2 shows one preferred method of securing the indicator 24 to the fuse 38. As may be seen in FIG. 8, the indicator includes a top side 40 and an underside 42. The underside 42 of the indicator 24 is placed upon conductive caps 44 which overlie the fuse body 44. In this way, the terminals 18 and 20 abut against these conductive caps 44. Cup-shaped fuse terminals 46 are then placed over the terminals 18 and 20 and the conductive caps 44. The indicator 24 is now electrically in series with the main element (not shown) of the fuse 38.

The resistance of the indicator 24 is much higher than the resistance of the main element of the fuse 38. Accordingly, when the fuse 38 is protecting its electrical circuit, virtually all of the current from that circuit passes through the main element of the fuse 38.

When the main element of the fuse 38 blows because of high overload or short circuit conditions, the current through the protected circuit is forced to go through the parallel indicator 24 circuit. Shortly after this current begins passing through the indicator 24, the wax 32 in the first resistance element 22 melts. When this wax 32 melts, it essentially dissolves into the first carbon strip 34 behind the wax 32. As a result, the light gray color of the wax 32 disappears, and only the dark, blackish color of the carbon strip 34 remains. This provides the user with a visual indication that the fuse 38 has blown. This visual indication is visible in FIG. 3, where a label 48 covers all of the indicator 24, except for a window portion which leaves the first resistance element 22 exposed. When the wax 32 portion of this first resistance element 22 melts, the first resistance element turns from its original gray color to the black color depicted in FIG. 3.

Shortly after the first resistance element 22 turns from the gray to the black color, the second resistance element 26 begins to increase in temperature. In a matter of a very short time, this heat creates a tear in the substrate 10 below this second resistance element 26. The second resistance element 26 thus creates an open circuit condition along the substrate 10 to interrupt current flow through the indicator device 24. As a result, the current flow through this indicator 24 is permanently interrupted.

As indicated above, this second resistance element 26 is also known as a clearing resistor. It was discovered that a device like the indicator 24 of the present invention, but lacking in this clearing resistor 26, had a tendency to arc, creating sparks resulting in a potential fire hazard.

It has been discovered that to make this second resistance element 26 or clearing resistor most effective for its intended purpose, the clearing resistor 26 should not be closely adjacent to or touch the body of the fuse 38 or any other surface. Accordingly, as may be seen in FIG. 2, the body of the fuse 38 includes a recessed portion 50. The recessed portion 50 extends a distance of approximately 0.300 inches along the length of the fuse. The surface of the recessed portion 50 is at a depth of approximately 0.015" from the surface of the rest of the body of the fuse 38. In this way, although the first resistance element 22 is adjacent to or abuts the surface of the body of the fuse 38, the second resistance element 26 does not contact the body of the fuse 38, as it is adjacent a recessed portion 50 of the body of the fuse 38.

The label 48 is secured to the body of the fuse 38 with an adhesive. Similarly, if the adhesive were to stick to the second resistance element 26, the contact of the label 48 with the second resistance element 26 would inhibit the function of the second resistance element 26, in the same way that contact of the element 26 with the fuse body would inhibit the function of the element 26. Thus, in order to prevent the adhesion of the label 48 to the second resistance element 26, the portion of the underside of the label 48 which overlies the second resistance element 26 is free of adhesive.

The dimensions depicted in FIG. 4 are as follows:

| Dimension | Inches |
|---|---|
| A | 0.155 |
| B | 0.020 |
| C | 0.030 |
| D | 0.020 |
| E | 0.050 |
| F | 0.125 |
| G | 0.050 |
| H | 0.020 |

It should be understood by those skilled in the art that more than two resistance elements may be needed for fuses having higher amperage and voltage ratings.

While a specific embodiment has been illustrated and described, numerous modifications will be evident to those of skill in the art which would not significantly departing from the spirit of the invention. Accordingly, the scope of protection is only limited by the scope of the accompanying claims, and not by the specification or drawings.

What we claim is:

1. A device for providing a visual indication of the status of a fuse, said device comprising:

(a) a substrate;

(b) a pair of conductive terminals imprinted upon said substrate, and spaced apart along said substrate;

(c) at least two resistance elements disposed on said substrate, in series with each other, and also in series with said pair of conductive terminals, said resistance elements being spaced apart and between said terminals;

(d) the first of said at least two resistance elements comprised of a combination of a substance which melts at an elevated temperature, and also of carbon; and (e) a second of said at least two resistance elements comprised of carbon.

2. The device of claim 1, wherein said conductive terminals are imprinted upon said substrate at the opposite ends of said substrate.

3. The device of claim 1, wherein said substrate is comprised of a clear polyester sheet.

4. The device of claim 1, wherein said imprinted conductive terminals are comprised of silver or tin.

5. The device of claim 1, wherein said imprinted conductive terminals are a part of a grid that is imprinted onto said substrate.

6. The device of claim 5, wherein said grid is screen printed onto said substrate.

7. A device for providing a visual indication of the status of a fuse, said device comprising:

(a) a flexible substrate;

(b) a grid that is imprinted upon said substrate, said grid having at its opposite ends a pair of conductive terminals;

(c) at least two resistance elements disposed on said substrate, in series with each other, and also in series with said pair of conductive terminals, said resistance elements being spaced apart and between said terminals;

(d) the first of said at least two resistance elements comprised of a combination of a wax and a carbon; and (e) a second of said at least two resistance elements comprised of a carbon.

8. The device of claim 7, wherein said substrate is comprised of a clear polyester sheet.

9. The device of claim 7, wherein said imprinted grid is comprised of silver or tin.

10. A device for providing a visual indication of the status of a fuse, said device comprising:

(a) a substrate;

(b) a pair of spaced apart, conductive terminals;

(c) at least two resistance elements disposed on said substrate, in series with each other, and also in series with said pair of conductive terminals, said resistance elements being spaced apart and between said terminals;

(d) the first of said at least two resistance elements comprised of a substance which changes colors upon changes in temperature; and (e) a second of said at least two resistance elements thereafter creating an open circuit condition along said substrate to interrupt current flow through said device.

* * * * *